US006289874B1

(12) United States Patent
Keefover

(10) Patent No.: US 6,289,874 B1
(45) Date of Patent: Sep. 18, 2001

(54) ELECTRONIC THROTTLE CONTROL

(75) Inventor: Robert D. Keefover, Farmington Hills, MI (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/539,565

(22) Filed: Mar. 31, 2000

(51) Int. Cl.[7] ..... F02D 11/10
(52) U.S. Cl. ..... 123/399; 123/361
(58) Field of Search ..... 123/399, 361

(56) References Cited

U.S. PATENT DOCUMENTS 5,454,358 * 10/1995 Hattori et al. ..... 123/399
5,498,943 * 3/1996 Kimoto et al. ..... 364/151
5,662,085 * 9/1997 Aubourg et al. ..... 123/361
5,992,383 * 11/1999 Scholten et al. ..... 123/399

* cited by examiner

*Primary Examiner*—Erick Solis
(74) *Attorney, Agent, or Firm*—Warn, Burgess & Hoffman, P.C.; Greg Dziegielewski

(57) ABSTRACT

A throttle control system including a throttle body, an air intake coupled to the throttle body providing air flow to the throttle body, a fuel supply apparatus coupled to the throttle body, where the air intake and the fuel supply apparatus, in conjunction, provide a combustible fuel-air mixture, a throttle plate coupled to the throttle body, an actuator coupled to the throttle plate to move the throttle plate within the throttle body to control at least the air flow to the throttle body, and a fuzzy logic controller controlling the actuator position and speed to provide for a desired air flow.

20 Claims, 3 Drawing Sheets

ELECTRONIC THROTTLE CONTROL

BACKGROUND OF THE INVENTION

The present invention relates to a throttle body and control system for a vehicle. More specifically the present invention relates to a control method and apparatus for controlling the position of a throttle plate in a throttle body.

Electronic engine control has evolved from a relatively elementary control system employing simple switches and analog devices to a highly precise fuel and ignition control system employing powerful microprocessors or microcontrollers. The miniaturization and cost reduction of powerful electronics has put the power of the computer age into the hands of automotive engineers. Microprocessors have allowed complex programs involving numerous variables to be used in the control of present day combustion engines, leading to better engine control and performance.

An important facet of combustion engine control is the regulation of air flow into a cylinder by a throttle and accordingly the quantity of fuel delivered into the cylinder. In a combustion engine a throttle, having a movable throttle plate, directly regulates the power produced by the combustion engine at any operating condition by regulating the air flow into the engine. The throttle plate is positioned to increase or decrease air flow into the engine. The engine acts as an air pump with the mass flow rate of air entering the engine varying directly with throttle plate angular position. Presently, there is a need in the art to precisely control throttle plate position in a throttle body to tightly regulate the flow of air and fuel into a cylinder.

In the operation of a standard vehicle combustion engine, a driver will depress the accelerator pedal to generate a portion of a throttle plate position command that varies the throttle plate angle and accordingly varies the air flow into the engine. Other factors besides driver pedal input such as engine temperature, engine speed, exhaust gas oxygen, exhaust gas recirculation valve position, air flow into the engine, and other similar variables will also factor into the a throttle plate position command, but are not limited to such. A control unit coupled to a fuel injector, monitoring the variables cited above, will regulate the fuel that is mixed with the air, such that the injected fuel generally increases in proportion to air flow. If a carburetor is used the air flow through the carburetor will directly regulate the amount of fuel mixed with the air, with respect to the vacuum or suction formed by the air flow through the throttle body. For any given fuel-air mixture, the power produced by the combustion engine is directly proportional to the mass flow rate of air into the engine controlled by the throttle plate position.

SUMMARY OF THE INVENTION

The positioning and stability of the throttle plate directly effects the tuning or stability of the engine. Ideally, when a position command is given to position the throttle plate, the throttle plate will step to that exact position without a large amount of overshoot and undershoot and at a desired angular speed. In practice, control algorithms attempt to approach this ideal condition. Proportional, Integral, and Derivative (PID) algorithms are typically used in the position control of a throttle plate in a throttle body. The output of a typical PID controller or algorithm can be represented by the equation:

$$\text{Output}=K_p e+K_I\int e(t)dt+K_D(de/dt)$$

where $K_p$=the proportional gain $K_I$=the integral gain $K_D$=the derivative gain and e=the error or difference between the setpoint or position command and the feedback.

In the present invention, a position command is generated using a combination of the operator input on the accelerator pedal and the engine variables cited above. This position command is processed by a PID control program executed on an electronic control unit that outputs a control command to a controller or drive controlling an electric motor. The controller or drive actuates the electric motor in response to the position command, and a position feedback sensor such as a potentiometer provides speed and position feedback for the electronic control unit. The error (the difference between the position command and the position feedback) is processed by the PID control program to generate a control command to the motor controller drive to reposition the motor in response to the error (if one exists). The PID gains in the PID control program and the scale of the error will determine the magnitude of the control command to the motor controller drive and thus the motor response. Higher PID gains (relatively determined by the response of the system) will normally shorten response time (again relative to the performance of the system) but also generate instability in the system. Lower PID gains will lengthen response time but minimize instability in the system.

A single set of PID gains for a throttle control system will normally be determined heuristically for the throttle control system, via the tradeoff between response time and stability in the system. This set of PID gains is traditionally fixed for the entire range of movement, position, and feedback variable values for the control program. This single set of PID gains cannot be optimized for the entire performance range of a throttle plate positioning system. For example, the PID gains that are optimal in a static state to overcome static friction for the motor will not perform as well in a dynamic state, i.e. when the throttle plate is constantly moved between different positions. Inertia generated by the angular speed of the throttle plate will also effect the performance of the system. Large angle changes of the throttle plate vs. small angle changes of the throttle plate have different optimal PID gains. One set of PID gains will not provide optimal performance for all the required moves of a throttle plate.

The present invention has overcome the limitations of the prior art by dynamically recalculating PID gains continuously during operation. A fuzzy supervisory control program will monitor throttle body position feedback and recalculate the PID gains for different error magnitudes, each specific state, speed, and/or position command for the throttle body, but is not limited to such. In this manner, optimal PID gains for every condition the throttle plate is involved in may be used, resulting in improved performance for the throttle system and engine compared to the prior throttle positioning systems.

DETAILED DESCRIPTION OF THE PREFERRED EMBODIMENT

The following description of the present invention is merely exemplary in nature and is in no way intended to limit the invention or its uses. Moreover, the following description, while depicting a control system designed to operate with a throttle body, is intended to adequately teach one skilled in the art to make and use a control system for a variety of positioning systems.

Figure 1:
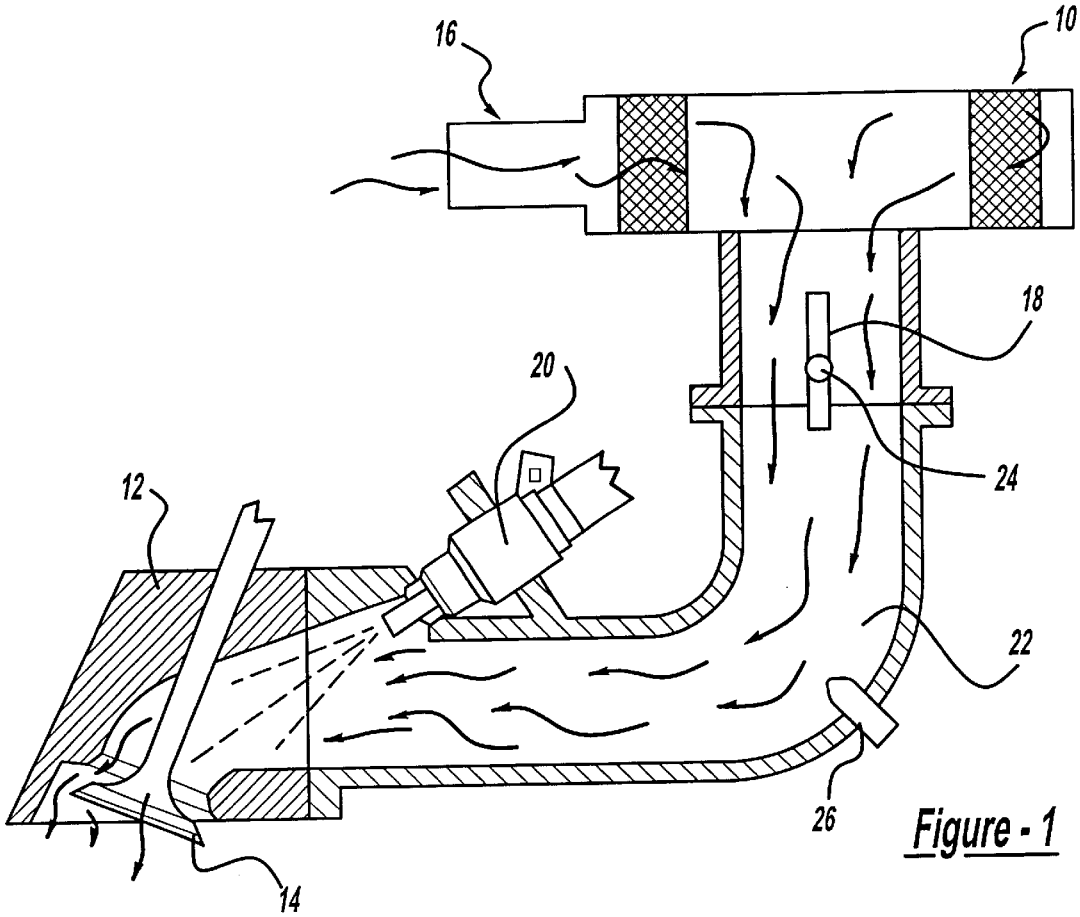
FIG. 1 is a diagrammatic drawing of a throttle body including a throttle plate.
Figure 2:
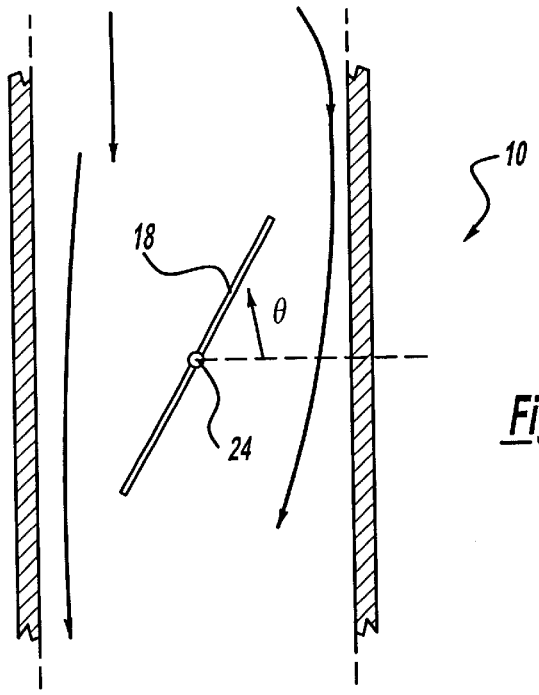
FIG. 2 is a diagrammatic drawing of the throttle plate within the throttle body.

Referring to FIG. 1, a throttle body 10 is shown coupled to a cylinder head 12 having an intake valve 14. The throttle body 10 includes an air intake 16, a throttle plate 18, a fuel injector 20, and an intake manifold 22. The air intake 16 provides air flow regulated by the angular position of the throttle plate 18. Referring to FIG. 2, the throttle plate 18 may be rotated to an angular position θ about pivot axis 24 to control the air flow. If the angle θ is equal to zero the throttle plate 18 will be in a position of maximum air flow constriction if the angle θ is equal to ninety degrees the throttle plate 18 will be in a position of maximum air flow. Accordingly, the air flow may have varying flow rates when the angle θ is varied between 0 and 90 degrees.

In the preferred embodiment of the present invention, the fuel injector 20 is mounted downstream of the throttle plate 18 in the intake manifold 22 in a multi-point configuration for each cylinder in a combustion engine. The fuel injector 20 will supply atomized fuel in response to a plurality of engine variables, including air flow in the intake manifold measured by air flow sensor 26, to provide a combustible fuel-air mixture. Preferably, the fuel injector 20 will supply fuel in proportion to the mass flow rate of air in the engine. The resultant air fuel mixture will enter a cylinder, via the intake valve 14, coupled to cylinder head 12. The timing of the fuel injector 20 firing corresponds to the cycle of the engine.

Figure 3:
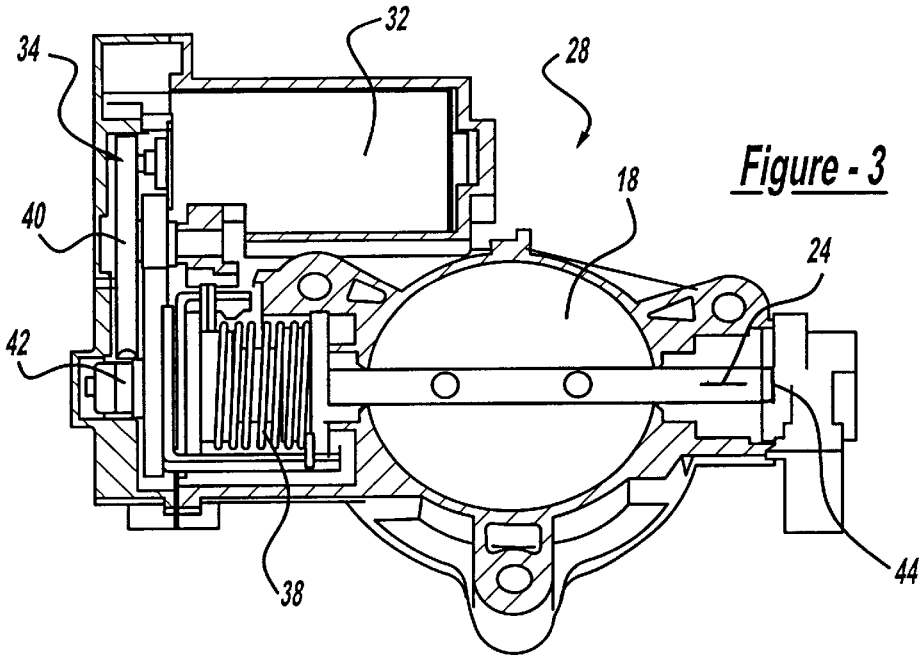
FIG. 3 is a cross-sectional diagram of a throttle control apparatus.

FIG. 3 is a cross-sectional diagram of a throttle control apparatus 30 of the present invention. The throttle control apparatus 30 includes a motor 32 coupled to a gear train 34 that is further coupled to the throttle plate 18 to rotate the throttle plate 18 about axis 24. A spring 38 exerts a torque onto the throttle plate 18. In normal operation the torque exerted by the motor 32, via the gear train 34, on the throttle plate 18 is opposite and greater than the torque exerted by the spring 38. In the event of a failure in the motor 32 or other mechanism in the throttle control apparatus, the spring 38 will bias the throttle plate 18 open to provide air flow to the combustion engine. This "limp" mode will enable the operator to drive the vehicle to a service provider to resolve problems with the throttle control apparatus 30.

The motor 32 is coupled to the gear train 34 to add resolution to the motor 32 movement as seen by the throttle plate 18. While generally the gear ratio can be selected as to any ratio suitable as to the conditions of response and torque output, the gear ratio is preferably 14 to 33. The gear train 34 includes a large gear 40 coupled to the motor 32 and a smaller gear 42 coupled to the large gear 40 and the throttle plate 18. In alternate embodiments of the present invention, the motor 32 will directly drive the throttle plate 18, eliminating the gear train 34.

The motor 32 is preferably a DC motor having a permanent magnet field and an armature. In one embodiment of the present invention, a pulse width modulated voltage is provided to the motor armature of the motor 32 to provide for speed and positioning of the motor 32, although any current waveform known in the art may be used. In alternate embodiments, AC motor, DC brushless motors, or vector drive or torque motor technology may be used in place of the DC motor.

A feedback device 44 is mounted to the throttle pivot axis 24 to provide feedback for the throttle plate 18 position. In the preferred embodiment the feedback device is a potentiometer, providing a voltage signal. In alternate embodiments a rotary voltage displacement transducer (RVDT) or rotary encoder (absolute or incremental) may be used.

Figure 4:
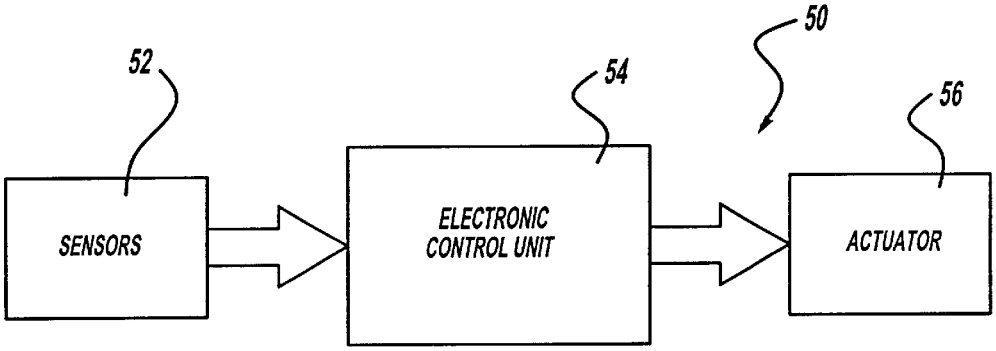
FIG. 4 is a simple block diagram of the control system of the present invention.
Figure 5:
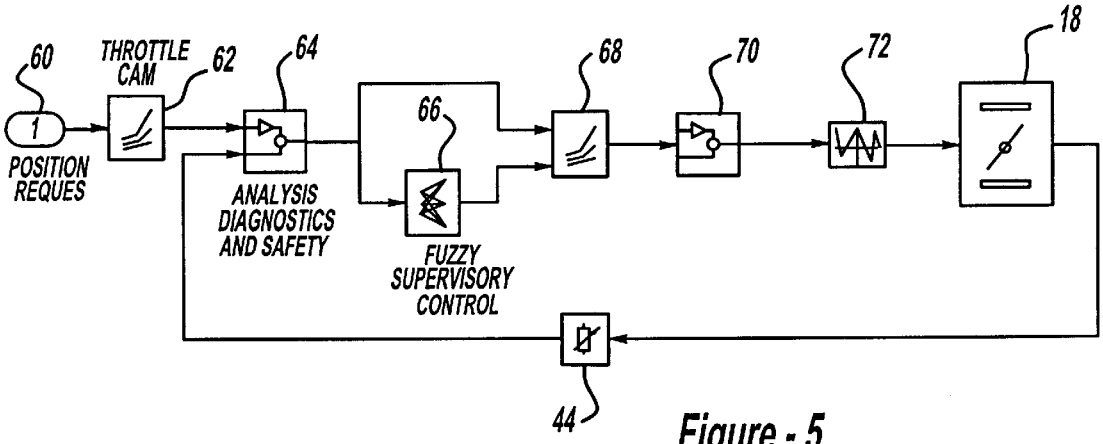
FIG. 5 is a block diagram of the control system of the present invention.

FIG. 4 is general diagram of the control system 50 of the present invention including sensors 52, such as the potentiometer 44, an electronic control unit 54 and an actuator 56 such as the motor 32. FIG. 5 is a more detailed control system diagram of the present invention. Referring to FIG. 5, the control system receives a throttle position request command from a car engine controller at block 60. The throttle position command is based upon numerous engine variables cited previously. The position command is transferred to a throttle CAM block 62 which generates a motion profile for the movement of the throttle plate 18 with a resultant final position equal to the position command. The motion profile is then factored into a safety block 64 to ensure that the motion profile is within safety parameters. A fuzzy supervisory control block 66 analyzes the position command profile, throttle position, error magnitude, and/or other throttle plate 18 variables to calculate PID gains (to be discussed in more detail below). The PID block 68 utilize the PID gains to calculate an output converted by a compensation and driver protection logic block 70 into a command for a motor drive 72. The command for the motor drive may be an analog signal or a digital signal. The PID block 68 may utilize any known PID algorithm known in the art and initial PID gains determined heuristically are used as a starting point for the PID block. The motor drive 72 generates a pulse width modulated (PWM) signal applied to the armature of the motor 32 driving the throttle plate 18 in the throttle body 10 and feedback is provided by throttle position sensors 44. The motor drive 72 may comprise any known DC motor drive known in the art, including triac and power transistor based DC motor drives. The fuzzy logic block 66 continuously calculates the PID gains for the PID control block 68 in response to varying position commands, motion profile, feedback and/or similar variables. In this manner PID gains optimal for all positions and states of the throttle body 18 may be utilized in the operation of the motor 32. The calculation speed of the fuzzy logic block 66 is only limited by the clock speed and input/output speed of the electronic control unit 54 and may be considered to operate at any clock speed possible and desired. The Fuzzy Logic Block 66 operation is detailed as follows:

1. DEFINE FUZZY MEMBERSHIP FUNCTIONS

A. Key Membership Functions Constants Definition

| | |
|---|---|
| Speed_low:=10 | |
| Speed_High:=25 | Inorm:=1 |
| | I_inc:=.25 |
| Error_Low:=75 | Ibig_n:=Inorm − 2·I_inc |
| Error_High:=300 | Ismall_n:=Inorm − 1·I_inc |
| Pos_LH:=40 | Ismall_p:=(norm+1·I_inc) |
| Pos_Range:=25 | |
| | Ibig_p:=Inorm+2·I_inc |
| Dbig_n:=.5 | Pbig_n:=.6 |
| Dsmall_n:=.6 | Psmall_n:=.9 |
| Dnorm:=1 | Pnorm:=1 |
| Dsmall_p:=1.4 | Psmall_p:=1.1 |
| Dbig_p:=1.5 | Pbig_p:=1.4 |

B. Input Functions

1. Speed Input Function $$\begin{aligned} X_int &:= Speed_Low \\ Slope &:= \frac{1}{Speed_High - Speed_Low} \end{aligned} \qquad R_speed4(x) := \left| \begin{array}{l} (Slope : x - (slope \cdot X_int)) \text{ if } x > Speed_Low \\ (1) \text{ if } x > Speed_High \\ (0) \text{ otherwise} \end{array} \right.$$

$$\begin{aligned} X_int &:= Speed_High \\ Slope &:= \frac{1}{Speed_Low - Speed_High} \end{aligned} \qquad R_speed3(x) := \left| \begin{array}{l} (1) \text{ if } x \geq 0 \\ (Slope \cdot x - (Slope \cdot X_int)) \text{ if } x > Speed_Low \\ (0) \text{ if } x > Speed_High \\ (0) \text{ otherwise} \end{array} \right.$$

$$\begin{aligned} X_int &:= -Speed_High \\ Slope &:= \frac{1}{Speed_High - Speed_Low} \end{aligned} \qquad R_speed2(x) := \left| \begin{array}{l} (1) \text{ if } x \leq 0 \\ (Slope \cdot x - (Slope \cdot X_int)) \text{ if } x < -Speed_Low \\ (0) \text{ if } x < -Speed_High \\ (0) \text{ otherwise} \end{array} \right.$$

$$\begin{aligned} X_int &:= -Speed_Low \\ Slope &:= \frac{1}{Speed_Low - Speed_High} \end{aligned} \qquad R_speed1(x) := \left| \begin{array}{l} (Slope \cdot x - (Slope \cdot X_int)) \text{ if } x < -Speed_Low \\ (1) \text{ if } x < -Speed_High \\ (0) \text{ otherwise} \end{array} \right.$$

2. Error Input Function $$\begin{aligned} X_int &:= Error_Low \\ Slope &:= \frac{1}{Error_High - Error_Low} \end{aligned} \qquad R_error4(x) := \left| \begin{array}{l} (Slope \cdot x - (Slope \cdot X_int)) \text{ if } x > Error_Low \\ (1) \text{ if } x > -Error_High \\ (0) \text{ otherwise} \end{array} \right.$$

$$\begin{aligned} X\text{-}int &:= Error_High \\ Slope &:= \frac{1}{Error_Low - Error_High} \end{aligned} \qquad R_error3(x) := \left| \begin{array}{l} (1) \text{ if } x \geq 0 \\ (Slope \cdot x - (Slope \cdot X_int)) \text{ if } x > Error_Low \\ (0) \text{ if } x > Error_High \\ (0) \text{ otherwise} \end{array} \right.$$

$$\begin{aligned} X_int &:= Error_High \\ Slope &:= \frac{1}{Error_High - Error_Low} \end{aligned} \qquad R_error2(x) := \left| \begin{array}{l} (1) \text{ if } x \leq 0 \\ (Slope \cdot x - (Slope \cdot X_int)) \text{ if } x < -Error_Low \\ (0) \text{ if } x < -Error_High \\ (0) \text{ otherwise} \end{array} \right.$$

$$\begin{aligned} X_int &:= -Error_Low \\ Slope &:= \frac{1}{Error_Low - Error_High} \end{aligned} \qquad R_error1(x) := \left| \begin{array}{l} (Slope \cdot x - (Slope \cdot X_int)) \text{ if } x < -Error_Low \\ (1) \text{ if } x < -Error_High \\ (0) \text{ otherwise} \end{array} \right.$$

3. Position Input Function $$\begin{aligned} X_int &:= Pos_LH - \frac{Pos\ Range}{2} \\ Slope &:= \frac{1}{Pos_Range} \end{aligned} \qquad R_pos2(x) := \left| \begin{array}{l} (Slope \cdot x - (Slope \cdot X_int)) \text{ if } x > Pos_LH - \frac{Pos\ Range}{2} \\ (1) \text{ if } x > Pos_LH + \frac{Pos\ Range}{2} \\ (0) \text{ otherwise} \end{array} \right.$$

-continued $$X_int := Pos_LH + \frac{Pos_Range}{2}$$

$$Slope := \frac{1}{-Pos_Range}$$

$$R_pos1(x) := \begin{cases} Slope \cdot x - (Slope \cdot X_int) \text{ if } x > Pos_LH - \frac{Pos_Range}{2} \\ (0) \text{ if } x > Pos_LH + \frac{Pos_Range}{2} \\ (1) \text{ otherwise} \end{cases}$$

C. Output Membership Functions (Functions are a Fuzzy "Singleton")

1. P Modifier Output Function $$R_pout1(x) := \begin{cases} 0 \text{ if } x < Pbig_n \\ (0) \text{ if } x > Pbig_n \\ (1) \text{ otherwise} \end{cases} \quad R_pout2(x) := \begin{cases} 0 \text{ if } x < Psmall_n \\ \text{if } x > Psmall_n \\ (1) \text{ otherwise} \end{cases} \quad R_pout3(x) := \begin{cases} 0 \text{ if } x < Pnorm \\ (0) \text{ if } x > Pnorm \\ (1) \text{ otherwise} \end{cases}$$

$$R_pout4(x) := \begin{cases} 0 \text{ if } x < Ibig_n \\ (0) \text{ if } x < Psmall_p \\ (1) \text{ otherwise} \end{cases} \quad R_pout5(x) := \begin{cases} 0 \text{ if } x < Pbig_p \\ (0) \text{ if } x > Pbig_p \\ (1) \text{ otherwise} \end{cases}$$

2. I Modifier Output Function $$R_iout1(x) := \begin{cases} 0 \text{ if } x < Ibig_n \\ (0) \text{ if } x > Ibig_n \\ (1) \text{ otherwise} \end{cases} \quad R_iout2(x) := \begin{cases} 0 \text{ if } x < Ismall_n \\ (0) \text{ if } x > Ismall_n \\ (1) \text{ otherwise} \end{cases} \quad R_oiut3(x) := \begin{cases} 0 \text{ if } x < Inorm \\ (0) \text{ if } x > Inorm \\ (1) \text{ otherwise} \end{cases}$$

$$R_iout4(x) := \begin{cases} 0 \text{ if } x < Ismall_p \\ (0) \text{ if } x > Ismall_p \\ (1) \text{ otherwise} \end{cases} \quad R_iout5(x) := \begin{cases} 0 \text{ if } x < Ibig_p \\ (0) \text{ if } x > Ibig_p \\ (1) \text{ otherwise} \end{cases}$$

3. D Modifier Output Function $$R_dout1(x) := \begin{cases} 0 \text{ if } x < Dbig_n \\ (0) \text{ if } x > Dbig_n \\ (1) \text{ otherwise} \end{cases} \quad R_dout2(x) := \begin{cases} 0 \text{ if } x < Dsmall_n \\ (0) \text{ if } x > Dsmall_n \\ (1) \text{ otherwise} \end{cases} \quad R_dout3(x) := \begin{cases} 0 \text{ if } x < Dnorm \\ (0) \text{ if } x > Dnorm \\ (1) \text{ otherwise} \end{cases}$$

$$R_dout4(x) := \begin{cases} 0 \text{ if } x < Dsmall_p \\ (0) \text{ if } x > Dsmall_p \\ (1) \text{ otherwise} \end{cases} \quad R_dout5(x) := \begin{cases} 0 \text{ if } x < Dbig_p \\ (0) \text{ if } x > Dbig_p \\ (1) \text{ otherwise} \end{cases}$$

2. DEVELOPE RULES & FUZZY INFERENCE ENGINE

A. Calculate the intersection of Each Fuzzy Input Set Combination

Note: This Can be doned with Either a "Max" Function or by "Multiplication"

IRule1(X,Y):=R_speed1(X)-R_error1(Y) I = "Norm":Speed = "High Neg" & Err = "High Neg"
IRule2(X,Y):=R_speed1(X)-R_error2(Y) I = "Big−":Speed = "High Neg" & Err = "Low Neg"
IRule3(X,Y):=R_speed1(X)-R_error3(Y) I = "Big+":Speed = "High Neg" & Err = "High Neg"
IRule4(X,Y):=R_speed1(X)-R_error4(Y) I = "Big+":Speed = "High Neg" & Err = "High Pos"
IRule5(X,Y):=R_speed2(X)-R_error1(Y) I = "Small+":Speed = "Log Neg" & Err = "High Neg"
IRule6(X,Y):=R_speed2(X)-R_error2(Y) I = "Sm+":Speed = "Low Neg" & Err = "Low Neg"
IRule7(X,Y):=R_speed2(X)-R_error3(Y) I = "Sm+":Speed "Low Neg" & Err = "Low Pos"
IRule8(X,Y):=R_speed2(X)-R_error4(Y) I = "Big+":Speed = "Low Neg" & Err = "High Pos"
IRule9(X,Y):=R_speed3(X)-R_error1(Y) I = "Big+":Speed = "Low Pos" & Err = "High Neg"
IRule10(X,Y):=R_speed3(X)-R_error2(Y) I = "Sm+":Speed = "Lo Pos" 7 Err = "Low Neg"
IRule11(X,Y):=R_speed3(X)-R_error3(Y) I = "Sm+":Speed = "Low Pos" & Err = "Low Pos"
IRule12(X,Y):=R_speed3(X)-R_error4(Y) I = "Sm+":Speed = "Low Pos" & Err = "High Pos"
IRrule13(X,Y):=R_speed4(X)-R_error1(Y) I = "Big+":Speed = "HighPos" & Err = "High Neg"
IRule14(X,Y):=R_speed4(X)-R_error2(Y) I = "Big+":Speed = "High Pos" & Err = "Low Neg"
IRule15(X,Y):=R_speed4(X)-R_error3(Y) I = "Big−":Speed = "High Pos" & Err = "Low Pos"
IRule16(X,Y):=R_speed4(X)-R_error4(Y) I = "Norm":Speed = "High Pos" & Err = "High Pos"

B. Use Inference Engine to Determine Output Function

Because This is a Fuzzy Singleton We can Assign Each Intersection Above Directly to its Implication
Without Using a more complex Inference Engine (eg. Union Of Each of the Above Intersections Over "x,y,z")

IBNsum(x,y) := IRule2(x,y) + IRule 15 (x,y)
ISNsum(x,y) := 0
INorsum(x,y) := IRule1(x,y) + IRule16(x,y)
ISPsum(x,y) :=IRule5(x,y) + IRule7(x,y) + IRule10(x,y) + IRule11(x,y) + IRule12(x,y)
IBPsum(x,y) := IRule3(x,y) + IRule4(x,y) + IRule8(x,y) + IRule9(x,y) + IRule 13 (x,y) + IRule 14(x,y)

-continued

3. DEFUZZIFY OUTPUT

Assign the output to equal the average value of the ending output membership function from the above.
This equation cancels the effect of the straight addition used above as the Union $$I_OUTPUT(x, y) := \left[\frac{Ibig_n \cdot (IBNsum(x, y)) + Ismall_n \cdot ISNsum(x, y) + INorm \cdot INorsum(x, y) + Ismall_p \cdot ISPsum(x, y) + Ibig_p \cdot IBPsum(x, y)}{IBNsum(x, y) + ISNsum(x, y) + Inorsum(x, y) + ISPsum(x, y) + IBPsum(x, y)}\right]$$

Figure 6:
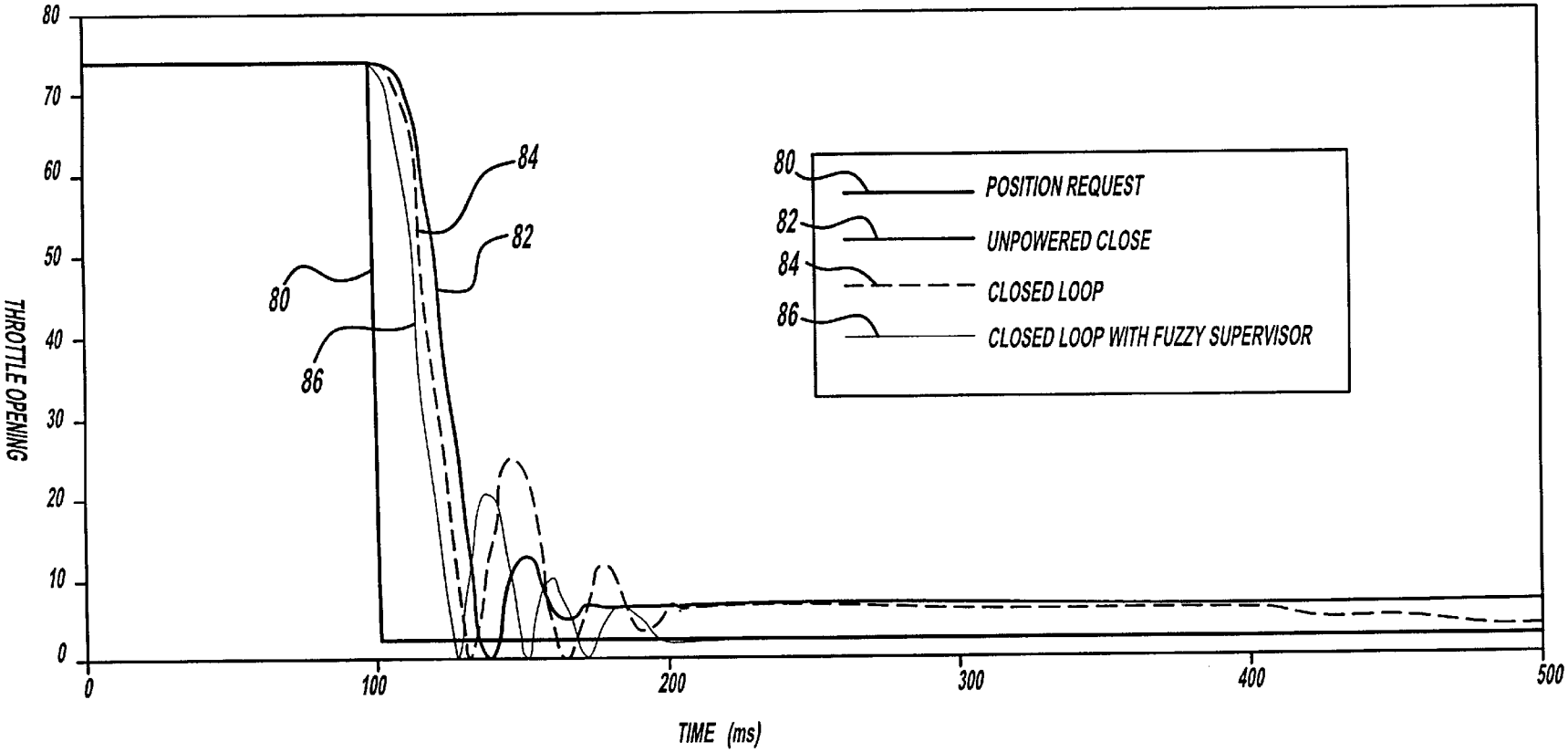
FIG. 6 is a graph detailing the response time performance impact of a fuzzy logic controller.

FIG. 6 is a graph detailing the improved response of the present invention utilizing the fuzzy logic block as a supervisor to dynamically recalculate optimal PID gains vs. the traditional fixed PID gain method. Graph 80 is the position request or command. Graph 82 is an unpowered close. Graph 84 is a graph showing the response of a standard PID algorithm with fixed PID gains. Graph 86 is a graph showing the improved response of the present system with the fuzzy supervisory logic. As can be seen from FIG. 6 graph 86 not only shows quicker response time than graph 84 but the overshoot and undershoot is also minimized.

It is to be understood that the invention is not limited to the exact construction illustrated and described above, but that various changes and modifications may be made without departing from the spirit and scope of the invention as defined in the following claims.

What is claimed is:

1. A throttle control system comprising:

a throttle body;

an air intake coupled to said throttle body providing air flow to said throttle body;

a fuel supply apparatus coupled to said throttle body, wherein said air intake and said fuel supply apparatus, in conjunction, provide a combustible fuel-air mixture;

a throttle plate coupled to said throttle body;

an actuator coupled to said throttle plate to move said throttle plate within said throttle body to control at least said air flow to said throttle body;

a speed and position feedback sensor for providing a positional sensing signal of said throttle plate; and a fuzzy logic controller taking said position sensing signal and dynamically controlling said actuator position and speed of actuation to provide for optimal performance in achieving a desired air flow.

2. The throttle control system of claim 1 wherein said actuator is an electric motor.

3. The throttle control system of claim 1 wherein said actuator is an electric motor coupled to said throttle plate, via a gear.

4. The throttle control system of claim 1 wherein said actuator is a DC motor having a motor shaft, said motor shaft directly coupled to said throttle plate.

5. The throttle control system of claim 1 wherein said throttle plate controls said fuel-air mixture flow.

6. The throttle control system of claim 1 wherein said fuel supply apparatus is a fuel injector.

7. The throttle control system of claim 1 wherein said fuel supply apparatus is a carburetor.

8. The throttle control system of claim 1 further comprising a speed and position feedback apparatus.

9. The throttle control system of claim 8 wherein said speed and position feedback apparatus is a potentiometer.

10. The throttle control system of claim 1 wherein said fuzzy logic controller comprises:

a microprocessor;

memory coupled to said microprocessor, said memory containing a fuzzy logic algorithm executed by said microprocessor, said fuzzy logic algorithm dynamically adjusting proportional and integral gains in a control loop having a feedback apparatus.

11. The throttle control system of claim 10 wherein said fuzzy logic algorithm further adjusts a derivative gain.

12. The throttle control system of claim 10 wherein a setpoint for said control loop is a position command received from an external control system.

13. The throttle control system of claim 10 wherein said feedback apparatus in potentiometer providing speed and position of said throttle plate.

14. The throttle control system of claim 10 wherein said fuzzy logic controller adjusts the proportional and integral gains with respect to at least one of the following variables, the magnitude of a throttle position command, position of said throttle plate, speed of said throttle plate, error between an actual throttle position and said throttle position command, and force needed to move said throttle plate.

15. The throttle control system of claim 14 wherein said force needed to move said plate is the force needed to overcome a static friction of said throttle plate in a static position.

16. The throttle control system of claim 10 wherein said proportional and integral gains are recalculated every 10 milliseconds.

17. A throttle actuator for a vehicle comprising:

an electric motor;

a throttle plate coupled to said electric motor;

a position feedback sensor for providing positional feedback of said throttle plate;

a controller controlling the actuation of said electric motor in response to said position feedback device signaling the position of said throttle plate and a position command for said throttle plate;

a proportional integral control algorithm, having a proportional gain and an integral gain, executed by said controller to control the actuation of said electric motor; and a fuzzy logic algorithm for continuously and dynamically adjusting said proportional and integral gains in response to the speed and position of said throttle plate for providing optimal PID gains based on input variables including said positional feedback.

18. The throttle actuator of claim 17 wherein said throttle plate is connected to said electric motor, via a gearbox.

19. A method of controlling a throttle plate in a throttle body comprising the steps of:

generating a position command for the throttle plate;

generating position feedback for the throttle plate from a position sensing device operably attached to said throttle plate;

actuating an electric motor coupled to the throttle plate to change the position of the throttle plate;

continuously calculating a control output to said electric motor using an error between said position command and said position feedback with a proportional and integral control loop; and using fuzzy logic algorithm for continuously and dynamically tuning optimum proportional and integral gains in said proportional and integral control loop in response to throttle plate variables.

20. The method of claim 19 further comprising the step of providing a gear boxy to couple said electric motor to said throttle plate.

* * * * *